US008400480B2

(12) United States Patent
Kim et al.

(10) Patent No.: US 8,400,480 B2
(45) Date of Patent: Mar. 19, 2013

(54) COLOR DISPLAY APPARATUS HAVING PIXEL PATTERN INCLUDING REPEATING UNITS

(75) Inventors: Yun Tae Kim, Yongin-si (KR); Chang Yeong Kim, Yongin-si (KR); Du-Sik Park, Suwon-si (KR); Seung Sin Lee, Yongin-si (KR); Wonhee Choe, Gyeongju-si (KR); Joo Hyung Lee, Gwacheon-si (KR); Jong Woung Park, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 821 days.

(21) Appl. No.: 11/923,971

(22) Filed: Oct. 25, 2007

(65) Prior Publication Data

US 2008/0252558 A1 Oct. 16, 2008

(30) Foreign Application Priority Data

Apr. 16, 2007 (KR) ..... 10-2007-0037091

(51) Int. Cl.
*G09G 5/02* (2006.01)

(52) U.S. Cl. ..... 345/694; 345/88

(58) Field of Classification Search ..... 345/55, 345/694, 87–88, 695, 690; 349/108
See application file for complete search history.

(56) References Cited

U.S. PATENT DOCUMENTS

| | | | | |
|---|---|---|---|---|
| 2003/0085906 | A1* | 5/2003 | Elliott et al. | 345/613 |
| 2004/0095521 | A1* | 5/2004 | Song et al. | 349/61 |
| 2005/0122294 | A1* | 6/2005 | Ben-David et al. | 345/87 |
| 2005/0168423 | A1* | 8/2005 | Hirata et al. | 345/88 |
| 2005/0270444 | A1* | 12/2005 | Miller et al. | 349/108 |
| 2007/0057901 | A1* | 3/2007 | Chino | 345/102 |
| 2007/0063946 | A1* | 3/2007 | Nakamura et al. | 345/88 |
| 2008/0043045 | A1* | 2/2008 | Natori et al. | 345/690 |
| 2008/0049048 | A1* | 2/2008 | Credelle et al. | 345/690 |
| 2008/0316235 | A1 | 12/2008 | Okazaki et al. | |

FOREIGN PATENT DOCUMENTS

| | | |
|---|---|---|
| JP | 2006-64993 | 3/2006 |
| JP | 2006-276797 | 10/2006 |
| KR | 2004-83648 | 10/2004 |
| KR | 10-2005-0059396 | 6/2005 |

(Continued)

OTHER PUBLICATIONS

Office Action issued by the Korean Intellectual Property Office in Korean Application No. 2007-37091 on Jul. 24, 2008.

(Continued)

*Primary Examiner* — Chanh Nguyen
*Assistant Examiner* — Pegeman Karimi
(74) *Attorney, Agent, or Firm* — Staas & Halsey LLP

(57) ABSTRACT

Disclosed herein is a color display apparatus which has a pixel pattern including a plurality of repeating units of a pixel array, wherein each of the plurality of repeating units of the pixel array is composed of at least five sub-pixels while including at least one sub-pixel from a first to fourth sub-pixel, respectively, the first sub-pixel representing a red color (R), the second sub-pixel representing a green color (G), the third sub-pixel representing a blue color (B), and the fourth sub-pixel representing a mixed color of at least two colors from among the R, G, and B, and each of the plurality of repeating units of the pixel array corresponds to at least two image pixels.

16 Claims, 4 Drawing Sheets

FOREIGN PATENT DOCUMENTS

| | | |
|---|---|---|
| KR | 10-2005-0065835 | 6/2005 |
| KR | 10-2005-013853 | 12/2005 |
| KR | 2006-117025 | 11/2006 |
| WO | WO 2006/018926 | 2/2006 |
| WO | WO2006/019025 | 2/2006 |

OTHER PUBLICATIONS

Notice of Allowance from Korean Patent Office dated Mar. 23, 2009 in corresponding Korean Application No. 2009-012472090.

* cited by examiner

COLOR DISPLAY APPARATUS HAVING PIXEL PATTERN INCLUDING REPEATING UNITS

CROSS-REFERENCE TO RELATED APPLICATION

This application claims the benefit of Korean Patent Application No. 10-2007-0037091, filed on Apr. 16, 2007, in the Korean Intellectual Property Office, the entire disclosure of which is incorporated herein by reference.

BACKGROUND OF THE INVENTION

1. Field of the Invention

The present invention relates to a color display apparatus, and more particularly, to a color display apparatus which provides a wide color gamut and a high luminance, and readily realizes a pixel pattern for representing colors.

2. Description of Related Art

In general, a variety of display apparatuses such as a liquid crystal display (LCD), an organic light-emitting diode (OLED), a plasma display panel (PDP), and the like, as well as display apparatuses mounted to mobile instruments such as a cellular phone, and the like, have been widely used.

In the case of the LCD, a color filter is disposed on a typical panel in order to represent color images. The color filter has a color pattern such as a red-color (R), a green-color (G), a blue-color (B), and the like, formed thereon in such a manner as to correspond to pixels.

In the case of the OLED and the PDP, a separate color filter is not provided, however, respective pixels spontaneously represent colors, thereby realizing various color images. Generally, in the display apparatuses as described above, three sub-pixels corresponding to R, G, and B are combined to form a single image pixel representing a variety of colors. The image pixel adjusts voltages or currents of respective sub-pixels, or controls turn-on time periods of the respective sub-pixels, thereby representing various colors. Recently, in order to realize a single image pixel, there has been developed a sub-pixel combination (RGBW) of a four-color method containing the R, G, B, and a white-color (W), as well as a sub-pixel combination of a three-color method containing the R, G, and B.

In a conventional pixel pattern as described above, image pixels composed of a specific combination such as "RGB" or "RGBW" are independently driven, and thus, there occurs a problem in that the driving of a pixel is complex and inefficient.

Also, there is an increased need for improving luminance of display apparatuses, as considering outdoor activities increased due to a current tendency of wide distribution of mobile display apparatuses.

SUMMARY OF THE INVENTION

An aspect of the present invention provides a color display apparatus in which a pixel pattern is readily and efficiently realized and driven, thereby providing a high luminance property.

According to an aspect of the present invention, there is provided a color display apparatus which has a pixel pattern including a plurality of repeating units of a pixel array, and each of the plurality of repeating units of the pixel array is composed of at least five sub-pixels while including at least one sub-pixel from a first to fourth sub-pixel, respectively, the first sub-pixel representing a red color (R), the second sub-pixel representing a green color (G), the third sub-pixel representing a blue color (B), and the fourth sub-pixel representing a mixed color of at least two colors from among the R, G, and B. Each of the plurality of repeating units of the pixel array corresponds to at least two image pixels.

In this instance, an occupancy ratio of the fourth sub-pixel to the total sub-pixels may be $\leqq 20\%$.

Also, at least one sub-pixel may be shared so as to correspond to two different image pixels.

Also, the repeating unit of the pixel array may include 5N sub-pixels, and correspond to 2N image pixels, where N is a natural number.

Also, each number of sub-pixels of at least any two sub-pixels from the first to fourth sub-pixel included in the repeating unit of the pixel array may be mutually different.

Also, sub-pixels included in the repeating unit of the pixel array may be arranged either in a row or two rows.

Also, the repeating unit of the pixel array may include at least two sub-pixels from the first to third sub-pixel, respectively, and sub-pixels representing an identical color are either arranged to be mutually adjacent or prevented from being arranged to be mutually adjacent.

Also, the repeating unit of the pixel array includes two fourth sub-pixels, and the two fourth sub-pixels are arranged to be mutually adjacent.

According to another aspect of the present invention, there is provided a color display apparatus which has a pixel pattern including a plurality of repeating units of a pixel array, and each of the plurality of repeating units of the pixel array is composed of a total number of ten sub-pixels while including at least one sub-pixel from a first to fourth sub-pixel, respectively, the first sub-pixel representing a red color (R), the second sub-pixel representing a green color (G), the third sub-pixel representing a blue color (B), and the fourth sub-pixel representing a mixed color of at least two colors from among the R, G, and B. Each of the plurality of repeating units of the pixel array corresponds to four image pixels.

According to still another aspect of the present invention, there is provided a color display apparatus which has a pixel pattern including a plurality of repeating units of a pixel array, and each of the plurality of repeating units of the pixel array is composed of a total number of five sub-pixels while including at least one sub-pixel from a first to fourth sub-pixel, respectively, the first sub-pixel representing a red color (R), the second sub-pixel representing a green color (G), the third sub-pixel representing a blue color (B), and the fourth sub-pixel representing a mixed color of at least two colors from among the R, G, and B. Each of the plurality of repeating units of the pixel array corresponds to two image pixels.

BRIEF DESCRIPTION OF THE DRAWINGS

The above and other aspects of the present invention will become apparent and more readily appreciated from the following detailed description of certain exemplary embodiments of the invention, taken in conjunction with the accompanying drawings of which.

DETAILED DESCRIPTION OF EXEMPLARY EMBODIMENTS

Figure 1A:
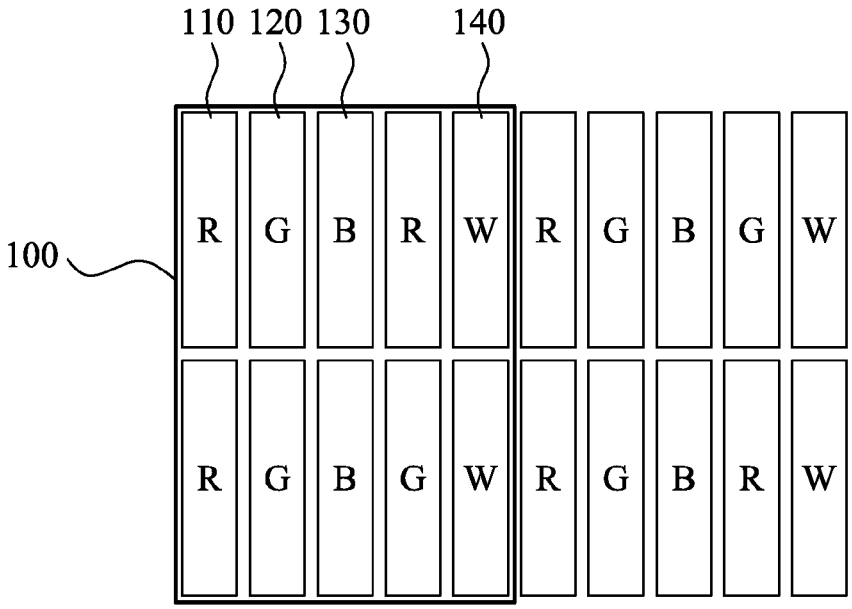
FIG. 1A is a plan view schematically illustrating a pixel pattern of a color display apparatus according to an exemplary embodiment of the present invention.

Reference will now be made in detail to exemplary embodiments of the present invention, examples of which are illustrated in the accompanying drawings, wherein like reference numerals refer to the like elements throughout. The exemplary embodiments are described below in order to explain the present invention by referring to the figures.

A color display apparatus of the present invention may include a variety of display apparatuses such as a liquid crystal display (LCD), an organic light-emitting diode (OLED), a plasma display panel (PDP), and the like.

The LCD realizes its pixel pattern through correspondence relation between a pixel configuration of the LCD and a color pattern of a corresponding color filter.

The OLED realizes its pixel pattern through a color array of unit organic light-emitting elements. The PDP realizes its pixel pattern through an array of discharge cells.

The present invention relates to a configuration of a pixel pattern regardless to the type of the display apparatuses as described above, and thus, the configuration of the pixel pattern of the present invention may be easily applied by those who skilled in the art depending on types and driving methods of display apparatuses through exemplary embodiments which will be described below. Therefore, hereinafter, pixel patterns according to various exemplary embodiments of the present invention will be mainly described.

FIG. 1A is a plan view schematically illustrating a pixel pattern of a color display apparatus according to an exemplary embodiment of the present invention.

Referring to FIG. 1A, according to the present exemplary embodiment of the invention, a group of sub-pixels 110, 120, 130, and 140 which are periodically repeated, that is, a repeating unit of a pixel array 100 is continuously arranged to form a pixel pattern.

The repeating unit of the pixel array 100 includes a first sub-pixel 110 representing a red-color (R), a second sub-pixel 120 representing a green-color (G), a third sub-pixel 130 representing a blue-color (B), and a fourth sub-pixel 140 representing a mixed color of at least two colors from among the R, G, and B.

According to the present exemplary embodiment of the invention, a sub-pixel representing a white-color (W) is used as the fourth sub-pixel 140. Specifically, the pixel pattern according to the present exemplary embodiment of the invention includes the repeating unit of the pixel array 100 which is basically composed of four primary colors of the R, G, B, and W.

When considering uses of the display apparatus, sub-pixels representing a mixed color of G and B, a mixed color of R and B, a mixed color of R and G, and the like, as well as the sub-pixel representing W, respectively, may be used as the fourth sub-pixel 140.

The repeating unit of the pixel array 100 includes three first sub-pixels 110 (R), three second sub-pixels 120 (G), two third sub-pixels 130 (B), and two fourth sub-pixels 140 (W). That is, a color ratio of each sub-pixel (R:G:B:W) in the repeating unit of the pixel array 100 is 3:3:2:2.

Accordingly, in the pixel pattern of the color display apparatus according to the present exemplary embodiment of the invention, each number of sub-pixels of at least any two sub-pixels from the first to fourth sub-pixel included in the repeating unit of the pixel array is mutually different. This is the same with other exemplary embodiments which will be described below.

The repeating unit of the pixel array 100 is composed of a total number of ten sub-pixels and corresponds to four image pixels. Specifically, two and a half sub-pixels correspond to a single image pixel, and accordingly, some of sub-pixels are shared in two different image pixels.

Thus, a pixel is efficiently driven by only about 5/6 of source integrated circuit (IC) in comparison with a conventional pixel pattern of a 2×2 method in which four combinations of R, G, and B correspond to four independent image pixels.

In the present exemplary embodiment of the invention, detailed explanation with respect to a specific driving signal of the repeating unit of the pixel array 100 will be omitted.

Every five sub-pixels of the repeating unit of the pixel array 100 are arranged in two rows. Further, the repeating unit of the pixel array 100 is formed in a stripe shape in which a set of R, G, and B is sequentially arranged. Unlike this, respective sub-pixels representing an identical color are prevented from being arranged to be mutually adjacent (mosaic method).

The repeating unit of the pixel array 100 of the present exemplary embodiment of the invention is configured to have two rows and a quadrilateral shape. However, unlike this, the repeating unit of the pixel array 100 may be configured to be arranged in a row. Further, the repeating unit of the pixel array 100 may be configured to have two rows in which each number of sub-pixels included in the respective rows is different from each other. That is, the pixel pattern according to the present exemplary embodiment of the invention may be arranged in a variety of methods depending on electrical driving signals, and include various shaped-repeating units of the pixel array 100 according to the variety of methods.

The repeating unit of the pixel array 100 includes adjacent two fourth sub-pixels 140. Similarly, the color display apparatus according to the present exemplary embodiment of the invention includes the fourth sub-pixel 140 representing W, and accordingly, provides an improved luminance.

An occupancy ratio of the fourth sub-pixel 140 to the repeating unit of the pixel array 100 is 0.2, and the fourth sub-pixel 140 is designed to have 20% or less in terms of an occupancy ratio thereof to the repeating unit of the pixel array 100, as can be seen from another exemplary embodiment which will be described below.

Four image pixels implemented by the repeating unit of the pixel array 100 may be formed in a variety of shapes depending on methods for driving the image pixels. Specifically, two and a half sub-pixels being adjacent in a row correspond to one image pixel. Further, any two and a half sub-pixels being adjacent and in different rows correspond to one image pixel. Also, the image pixel implemented in response to driving signals for driving the repeating unit of the pixel array 100 may be variable. This differs substantially from a display apparatus including independent image pixels corresponding to three or four sub-pixels.

That is, the display apparatus according to the present exemplary embodiment of the invention has a pixel pattern including the repeating unit of the pixel array 100 as a basic repeating unit of an array. Here, the repeating unit of the pixel array 100 is different from a repeating unit of basic combination of R, G, B, and the like.

In the repeating unit of the pixel array 100 according to the present exemplary embodiment of the invention, an occupancy ratio of the first sub-pixel 110, representing R, to the total sub-pixels is 0.3 to thereby have an advantage in expressing color saturation of R.

Also, the repeating unit of the pixel array 100 is formed in a stripe shape, and thus, is advantageous to express pixels arranged in a vertical direction.

Figure 1B:
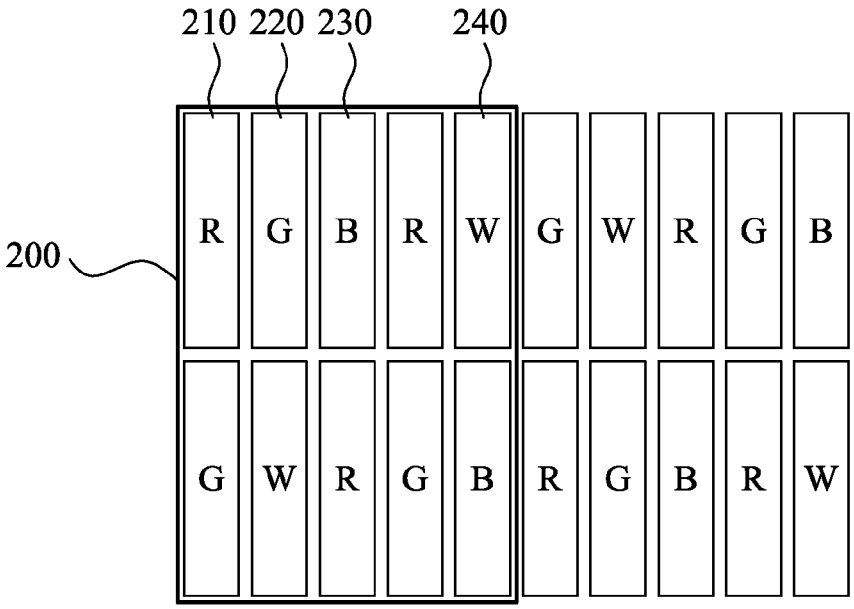
FIG. 1B is a plan view schematically illustrating a pixel pattern of a color display apparatus according to another exemplary embodiment of the present invention.

FIG. 1B is a plan view schematically illustrating a pixel pattern of a color display apparatus according to another exemplary embodiment of the present invention. The pixel pattern of FIG. 1B has an identical configuration to that of the pixel pattern of FIG. 1A except for an array of sub-pixels, and repetitive explanations will be omitted.

Referring to FIG. 1B, the repeating unit of the pixel array 200 according to the present exemplary embodiment of the invention includes a first sub-pixel 210 representing R, a second sub-pixel 220 representing G, a third sub-pixel 230 representing B, and a fourth sub-pixel 240 representing W.

The repeating unit of the pixel array 200 includes three first sub-pixels 210, three second sub-pixels 220, two third sub-pixels 230, and two fourth sub-pixels 240. Specifically, a color ratio of respective sub-pixels to the repeating unit of the pixel array 200 (R:G:B:W) is 3:3:2:2.

According to the present exemplary embodiment, sub-pixels representing an identical color are prevented from being arranged to be mutually adjacent. Thus, the pixel pattern according to the present exemplary embodiment may represent a gentle gradation. Specifically, the repeating unit of the pixel array 200 according to the present exemplary embodiment is formed in a mosaic shape.

Figure 2A:
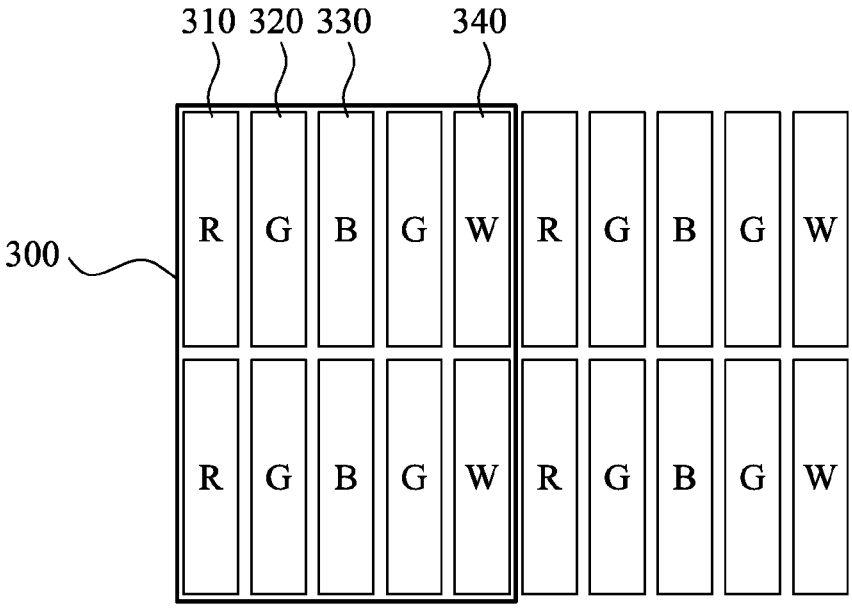
FIG. 2A is a plan view schematically illustrating a pixel pattern of a color display apparatus according to still another exemplary embodiment of the present invention.

FIG. 2A is a plan view schematically illustrating a pixel pattern of a color display apparatus according to still another exemplary embodiment of the present invention.

The pixel pattern of FIG. 2A has an identical configuration to that of the pixel pattern of FIG. 1A except for an array of sub-pixels, and repetitive explanations will be omitted.

Referring to FIG. 2A, a repeating unit of a pixel array 300 according to the present exemplary embodiment includes a first sub-pixel 310 representing R, a second sub-pixel 320 representing G, a third sub-pixel 330 representing B, and a fourth sub-pixel 340 representing W.

The repeating unit of the pixel array 300 includes two first sub-pixels 310, four second sub-pixels 320, two third sub-pixels 330, and two fourth sub-pixels 340. Specifically, a color ratio of respective sub-pixels to the repeating unit of the pixel array 300 (R:G:B:W) is 2:4:2:2.

Further, every two sub-pixels representing an identical color are vertically arranged in a row (stripe shape).

In the repeating unit of the pixel array 300 according to the present exemplary embodiment of the invention, an occupancy ratio of the second sub-pixel 320 to the total sub-pixels is 0.4 to thereby represent an extremely high luminance. Also, as described above, the repeating unit of the pixel array 300 is formed in a stripe shape, and thus, is advantageous to express pixels arranged in a vertical direction.

Figure 2B:
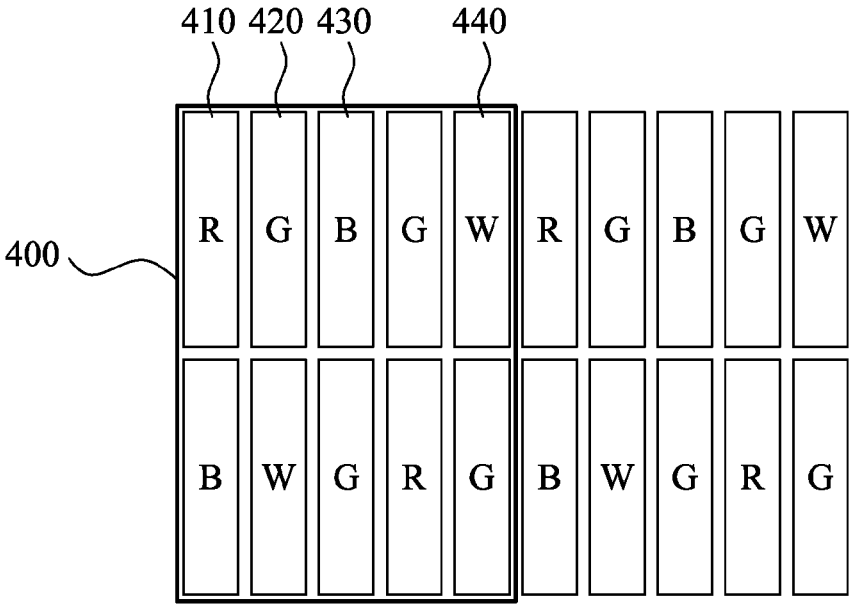
FIG. 2B is a plan view schematically illustrating a pixel pattern of a color display apparatus according to yet another exemplary embodiment of the present invention.

FIG. 2B is a plan view schematically illustrating a pixel pattern of a color display apparatus according to yet another exemplary embodiment of the present invention. The pixel pattern of FIG. 2B has an identical configuration to that of the pixel pattern of FIG. 2A except for an array of sub-pixels in a repeating unit of a pixel array, and repetitive explanations will be omitted.

Referring to FIG. 2B, a repeating unit of a pixel array 400 according to the present exemplary embodiment of the invention includes a first sub-pixel 410 representing R, a second sub-pixel 420 representing G, a third sub-pixel 430 representing B, and a fourth sub-pixel 440 representing W.

The repeating unit of the pixel array 400 according to the present exemplary embodiment of the invention is relatively advantageous to express a gentle gradation in comparison with the repeating unit of the pixel array 300 of FIG. 2A.

Figure 3A:
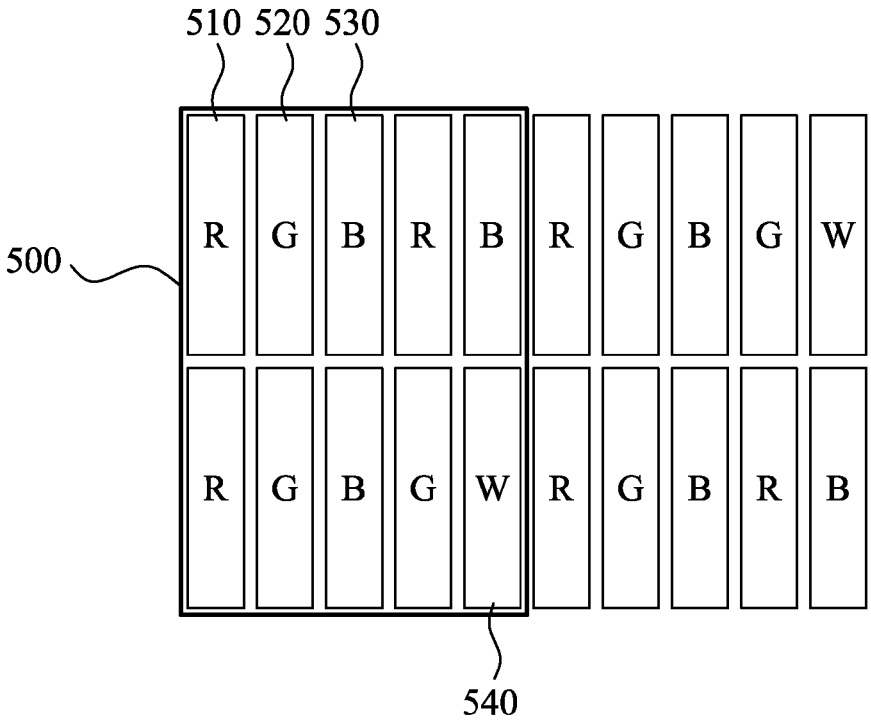
FIG. 3A is a plan view schematically illustrating a pixel pattern of a color display apparatus according to a further exemplary embodiment of the present invention.

FIG. 3A is a plan view schematically illustrating a pixel pattern of a color display apparatus according to a further exemplary embodiment of the present invention. The pixel pattern of FIG. 3A has an identical configuration to that of the pixel pattern of FIG. 1A except for a number and an array of sub-pixels, and repetitive explanations will be omitted.

Referring to FIG. 3A, a repeating unit of a pixel array 500 according to the present exemplary embodiment of the invention includes a first sub-pixel 510 representing R, a second sub-pixel 520 representing G, a third sub-pixel 530 representing B, and a fourth sub-pixel 540 representing W.

The repeating unit of the pixel array 500 includes three first sub-pixels 510, three second sub-pixels 520, three third sub-pixels 530, and one fourth sub-pixel 540. Specifically, a color ratio of respective sub-pixels to the repeating unit of the pixel array 500 (R:G:B:W) is 3:3:3:1.

Further, every two sub-pixels representing an identical color are vertically arranged in a row (stripe shape).

Also, the repeating unit of the pixel array 500 according to the present exemplary embodiment of the invention includes one fourth sub-pixel 540.

In the repeating unit of the pixel array 500 according to the present exemplary embodiment of the invention, an occupancy ratio of the fourth sub-pixel 540 to the total sub-pixels is 0.1 to thereby represent a relatively low luminance. However, each occupancy ratio of the first sub-pixel 510, the second sub-pixel 520, and the fourth sub-pixel 540 to the total sub-pixels is 0.3, and thus it is advantageous to express a high saturation. Further, in the repeating unit of the pixel array 500, since each occupancy ratio of sub-pixels representing R, G, and B is equivalent to one another, color balancing is facilitated.

Figure 3B:
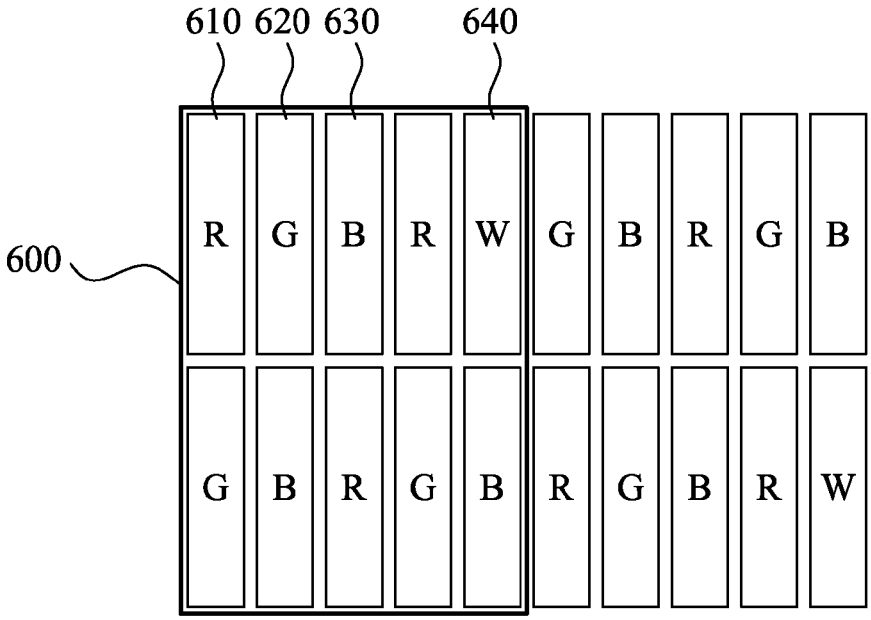
FIG. 3B is a plan view schematically illustrating a pixel pattern of a color display apparatus according to another exemplary embodiment of the present invention.

FIG. 3B is a plan view schematically illustrating a pixel pattern of a color display apparatus according to another exemplary embodiment of the present invention. The pixel pattern of FIG. 3B has an identical configuration to that of the pixel pattern of FIG. 3A except for an array of sub-pixels in a repeating unit of a pixel array, and repetitive explanations will be omitted.

Referring to FIG. 3B, a repeating unit of a pixel array 600 according to the present exemplary embodiment of the invention includes a first sub-pixel 610 representing R, a second sub-pixel 620 representing G, a third sub-pixel 630 representing B, and a fourth sub-pixel 640 representing W.

The repeating unit of the pixel array 600 according to the present exemplary embodiment of the invention is relatively advantageous to express a gentle gradation in comparison with the repeating unit of the pixel array 500 of FIG. 3A.

Figure 4A:
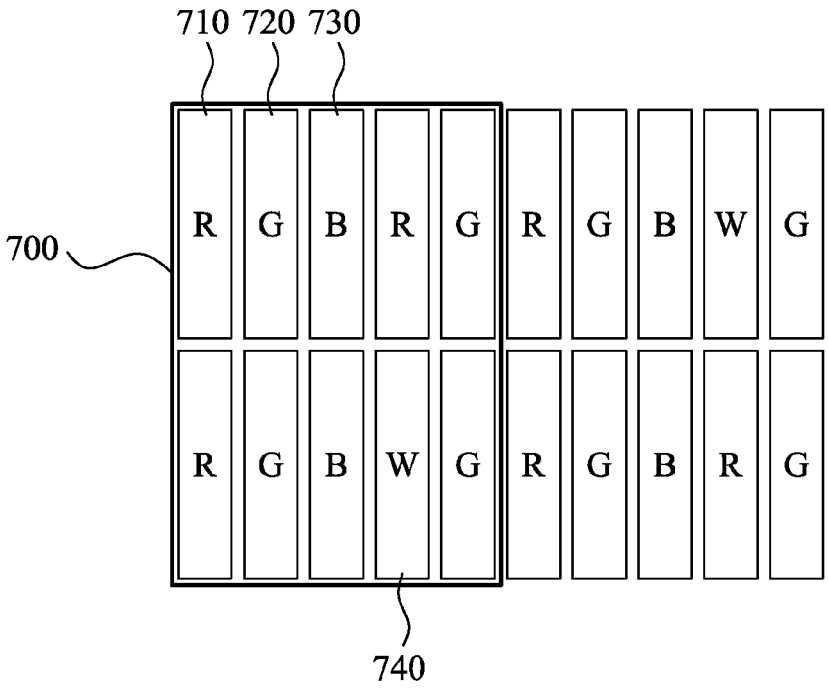
FIG. 4A is a plan view schematically illustrating a pixel pattern of a color display apparatus according to another exemplary embodiment of the present invention.

FIG. 4A is a plan view schematically illustrating a pixel pattern of a color display apparatus according to another exemplary embodiment of the present invention. The pixel pattern of FIG. 4A has an identical configuration to that of the pixel pattern of FIG. 1A except for a number and an array of sub-pixels, and repetitive explanations will be omitted.

Referring to FIG. 4A, a repeating unit of a pixel array 700 according to the present exemplary embodiment of the invention includes a first sub-pixel 710 representing R, a second sub-pixel 720 representing G, a third sub-pixel 730 representing B, and a fourth sub-pixel 740 representing W.

The repeating unit of the pixel array 700 includes three first sub-pixels 710, four second sub-pixels 720, two third sub-pixels 730, and one fourth sub-pixel 740. Specifically, a color ratio of respective sub-pixels to the repeating unit of the pixel array 700 (R:G:B:W) is 3:4:2:1.

Further, every two sub-pixels representing an identical color are vertically arranged in a row (stripe shape).

In the repeating unit of the pixel array 700 according to the present exemplary embodiment of the invention, an occupancy ratio of the fourth sub-pixel 740 to the total sub-pixels is 0.1, however, an occupancy ratio of the second sub-pixel 720 to the total sub-pixels is 0.3, to thereby represent a high luminance. Further, in the repeating unit of the pixel array 700, an occupancy ratio of the first sub-pixel 710 to the total sub-pixels is 0.3, and thus it is advantageous to express a high saturation.

Figure 4B:
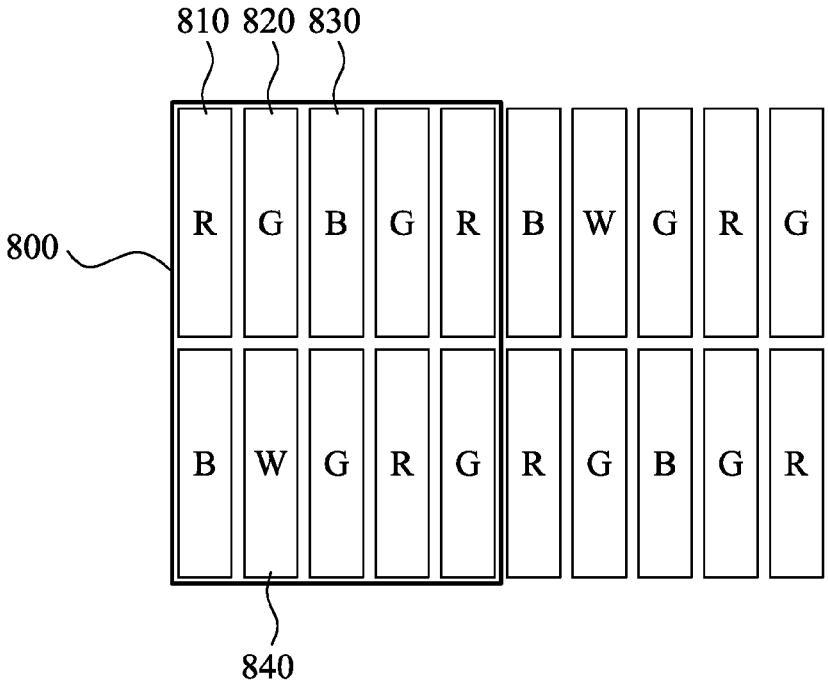
FIG. 4B is a plan view schematically illustrating a pixel pattern of a color display apparatus according to another exemplary embodiment of the present invention.

FIG. 4B is a plan view schematically illustrating a pixel pattern of a color display apparatus according to another exemplary embodiment of the present invention.

The pixel pattern of FIG. 4B has an identical configuration to that of the pixel pattern of FIG. 4A except for an array of sub-pixels in a repeating unit of a pixel array, and repetitive explanations will be omitted.

Referring to FIG. 4B, the repeating unit of the pixel array 800 according to the present exemplary embodiment of the invention includes a first sub-pixel 810 representing R, a second sub-pixel 820 representing G, a third sub-pixel 830 representing B, and a fourth sub-pixel 840 representing W.

The repeating unit of the pixel array 800 according to the present exemplary embodiment of the invention is relatively advantageous to express a gentle gradation in comparison with the repeating unit of the pixel array 700 of FIG. 4A.

As described above, according to the color display apparatus, the repeating unit of the pixel array having been grouped is provided so that two and a half sub-pixels substantially corresponds to a single image pixel, thereby economically enabling the pixel pattern, and thus, being advantageous to express a high luminance.

Therefore, it is highly expected to be efficient when the display apparatus according to the present invention is applied to a mobile display apparatus and the like, which is frequently used, in particular, in outdoor activities.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. A color display apparatus comprising:

a pixel pattern including a plurality of repeating units of a pixel array, wherein each of the plurality of repeating units of the pixel array corresponds to I image pixels and is comprised of I*N+(I/2) physical sub-pixels, where I is an even natural number of image pixels greater than or equal to 2 and N is a natural number greater than or equal to 2, while including at least one physical sub-pixel from a first sub-pixel type to a fourth sub-pixel type, respectively, the first sub-pixel type representing a red color "R", the second sub-pixel type representing a green color "G", the third sub-pixel type representing a blue color "B", and the fourth sub-pixel type representing a mixed color comprised of at least two colors including a white color "W" and at least one other color from among the R, G, and B, each of the plurality of repeating units of the pixel array corresponds to I image pixels, and each image pixel corresponds to only N+½ physical sub-pixels.

2. The apparatus of claim 1, wherein the fourth sub-pixel type represents only a white color "W".

3. The apparatus of claim 1, wherein an occupancy ratio of the fourth sub-pixel type to the total physical sub-pixels is ≦20%.

4. The apparatus of claim 1, wherein I is equal to 2 and N is equal to 2.

5. The apparatus of claim 1, wherein each number of physical sub-pixels of at least any two sub-pixel types from the first to fourth sub-pixel type included in the repeating unit of the pixel array is mutually different.

6. The apparatus of claim 1, wherein physical sub-pixels included in the repeating unit of a pixel array are arranged in a row.

7. The apparatus of claim 1, wherein physical sub-pixels included in the repeating unit of the pixel array are arranged in two rows.

8. The apparatus of claim 1, wherein the repeating unit of the pixel array includes at least two physical sub-pixels from the first to third sub-pixel types, respectively, wherein physical sub-pixels representing an identical color are arranged to be mutually adjacent.

9. The apparatus of claim 1, wherein the repeating unit of the pixel array includes at least two physical sub-pixels from the first to third sub-pixel types, respectively, and the physical sub-pixels representing an identical color are prevented from being arranged to be mutually adjacent.

10. The apparatus of claim 1, wherein the repeating unit of the pixel array includes two physical sub-pixels of the fourth sub-pixel type, and the two physical sub-pixels of the fourth sub-pixel type are arranged to be mutually adjacent.

11. A color display apparatus comprising a pixel pattern including a plurality of repeating units of a pixel array, wherein each of the plurality of repeating units of the pixel array corresponds to four image pixels and is comprised of a total number of ten physical sub-pixels while including at least one physical sub-pixel from a first sub-pixel type to a fourth sub-pixel type, respectively, the first sub-pixel type representing a red color "R", the second sub-pixel type representing a green color "G", the third sub-pixel type representing a blue color "B", and the fourth sub-pixel type representing a mixed color comprised of at least two colors including a white color "W" and at least one other color from among the R, G, and B, each of the plurality of repeating units of the pixel array corresponds to four image pixels, and each image pixel corresponds to only 2½ physical sub-pixels.

12. The apparatus of claim 11, wherein the repeating unit of the pixel array includes the first, second, third, and fourth sub-pixel types, respectively, to have a ratio of the number of the first to fourth sub-pixel types of 3:3:2:2.

13. The apparatus of claim 11, wherein the repeating unit of the pixel array includes the first, second, third, and fourth sub-pixel types, respectively, to have a ratio of the number of the first to fourth sub-pixel types of 2:4:2:2.

14. The apparatus of claim 11, wherein the repeating unit of the pixel array includes the first, second, third, and fourth sub-pixel types, respectively, to have a ratio of the number of the first to fourth sub-pixel types of 3:3:3:1.

15. The apparatus of claim 11, wherein the repeating unit of the pixel array includes the first, second, third, and fourth sub-pixel types, respectively, to have a ratio of the number of the first to fourth sub-pixel types of 3:4:2:1.

16. A color display apparatus comprising:

a pixel pattern including a plurality of repeating units of a pixel array, wherein each of the plurality of repeating units of the pixel array corresponds to two image pixels and is comprised of a total number of five physical sub-pixels while including at least one physical sub-pixel from a first sub-pixel type to a fourth sub-pixel type, respectively, the first sub-pixel type representing a red color "R", the second sub-pixel type representing a green color "G", the third sub-pixel type representing a blue color "B", and the fourth sub-pixel type representing a mixed color comprised of at least two colors including a white color "W" and at least one other color from among the R, G, and B, each of the plurality of repeating units of the pixel array corresponds to two image pixels, and each image pixel corresponds to only 2½ physical sub-pixels.

* * * * *